252-103 AU 166 EX
3/31/81 XR 4,259,200

United States Patent [19]
Sims et al.

[11] 4,259,200
[45] Mar. 31, 1981

[54] BLEACHING AND CLEANING COMPOSITIONS

[75] Inventors: Peter S. Sims, Chester; Robin S. Heslam, Birkenhead; Richard L. Morris, Tarporley, all of England

[73] Assignee: Lever Brothers Company, New York, N.Y.

[21] Appl. No.: 135,416

[22] Filed: Mar. 31, 1980

[30] Foreign Application Priority Data

Apr. 6, 1979 [GB] United Kingdom ..... 12141/79

[51] Int. Cl.[3] ..... C11D 7/54
[52] U.S. Cl. ..... 252/102; 252/95; 252/98; 252/99; 25/103
[58] Field of Search ..... 252/102, 98, 99, 186, 252/95, 103

[56] References Cited

U.S. PATENT DOCUMENTS 4,110,242 8/1978 Hase et al. ..... 252/102 X
4,129,517 12/1978 Eggensyerger et al. ..... 252/102 X

*Primary Examiner*—Mayer Weinblatt
*Attorney, Agent, or Firm*—Melvin H. Kurtz

[57] ABSTRACT

The stability of ethylene diamine tetra-(methylene phosphate)—EDTMA—and diethylene triamine penta-(methylene phosphonate)—DTPMP—incorporated as peracid stabilizer in bleaching and cleaning compositions comprising a percompound and an organic activator for said percompound is improved if said phosphonate compound is present as a complex of a metal ion selected from the group consisting of calcium, magnesium, zinc and aluminium ions, the molar ratio of said metal ion to said phosphonate compound in the complex being at least 1:1. Compositions comprising a percompound bleach, an organic activator and said metal complex of EDTMP or of DTPMP are provided.

13 Claims, No Drawings

BLEACHING AND CLEANING COMPOSITIONS

This invention relates to improved bleaching and cleaning compositions comprising a percompound bleach and an organic activator, and to a method of preparing said compositions.

Bleaching and cleaning compositions containing inorganic percompounds and organic activators therefor, with or without organic detergent substances having a cleaning action and builders, are known in the art. These organic activators are generally carboxylic acid derivatives, e.g. esters (such as those described in British Pat. Nos. 836,988 and 970,950), acylamides (such as those described in British Pat. Nos. 907,356, 855,735, 1,246,339 and U.S. Pat. No. 4,128,494), acyl azoles (such as those described in Canadian Pat. No. 844,481), acyl imides (such as those described in South African Pat. No. 68/6344), and triacyl cyanurates (such as those described in U.S. Pat. No. 3,332,882). Such bleaching and cleaning compositions exert their bleaching action by the formation of organic peracids from the reaction of the organic activator with the percompound, which organic peracids, unlike the inorganic percompounds, are effective in bleaching at lower temperatures.

The term "percompound" is used here to indicate those percompounds which liberate active oxygen in solution, such as the alkali metal perborates, persilicates, percarbonates and perphosphates.

It is also known that specific organic phosphonate compounds are incorporated in such bleaching and cleaning compositions as a stabilising agent for the percompound and the peracid in solution. The use of said organic phosphonate compounds improves the bleaching efficiency of percompound/activator bleach systems by the ability of said organic phosphonic compounds to inhibit the deleterious side-reaction occurring in the wash solution between the peracid formed and the percompound, resulting thereby in a loss of bleaching efficiency. Ethylene diamine tetra-(methylene phosphonate)— "EDTMP"—and diethylene triamine penta-(methylene phosphonate)—"DTPMP"—are particularly effective peracid stabilisers. These compounds both in their acid form and in their alkali metal salt form are known sequestering agents.

Unfortunately, however, these organic phosphonate compounds, when used in formulations comprising a percompound bleach and an activator for percompounds, are unstable during storage. It is thought that the organic phosphonate compound is converted into an inactive species due to oxidative attack in stages e.g. according to the following reactions:

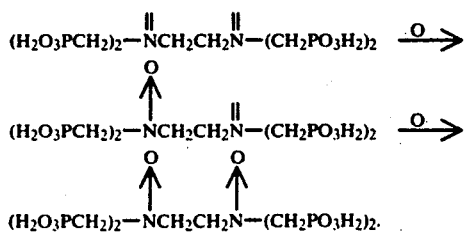

In fact it has been established that the loss of this valuable ingredient in the composition during storage can be quite substantial, especially when the ingredient is incorporated therein via the slurry before spray-drying the detergent composition. The result is that there will be insufficient stabilisation of peracid and thereby an optimal bleaching result cannot be obtained, unless a dosage higher than necessary of this expensive ingredient is employed to compensate the loss during storage.

It is an object of the present invention to improve the stability of EDTMP and DTPMP peracid stabilisers in bleaching and cleaning compositions comprising a percompound and an organic activator for percompounds.

It has now been found that the above object can be achieved if said organic phosphonate compounds are presented as complexes of a metal ion selected from the group consisting of calcium, magnesium, zinc and aluminium ions, the molar ratio of said metal ion to the organic phosphonate compound being at least 1:1, preferably at least 2:1.

It is not known exactly what chemical conversion has taken place, which causes the organic phosphonate compound to be more resistant to oxidative attack, but it is believed that the organic phosphonate compound forms a complex with the metal ion, thereby protecting the nitrogen atoms in said organic phosphonate compounds from oxidation in a manner as shown in the following structure:

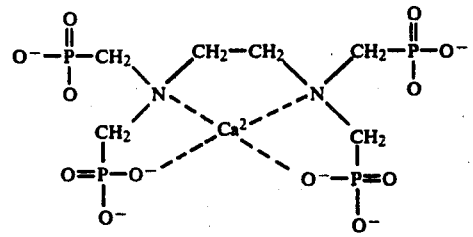

Accordingly the invention provides a bleaching and cleaning composition comprising a percompound bleach, an activator for said percompound and an organic phosphonate compound, selected from the group consisting of ethylene diamine tetra-(methylene phosphonate)—"EDTMP"—and diethylene triamine penta-(methylene phosphonate)—"DTPMP"—and mixtures thereof, wherein said organic phosphonate compound is present as a complex of a metal ion selected from the group consisting of calcium, magnesium, zinc and aluminium ions, the molar ratio of said metal ion to said phosphonate compound being at least 1:1, preferably at least 2:1.

Depending on the molar ratio (n:1) of metal ion to phosphonate compound in the complex, the specific complexes will be further referred to as the $metal_n$ complex of EDTMP or the $metal_n$ complex of DTPMP for example $Ca_3$- EDTMP, $Mg_3$- EDTMP, $Al_2$- EDTMP and $Zn_1$ - EDTMP.

No substantial improvement in stability was observed with a system wherein the molar ratio of metal ion to phosphonate compound is lower than 1:1.

Though a molar ratio of metal ion to phosphonate compound higher than 3:1 can be used, this is usually not necessary, since there is substantially no additional advantage.

The choice of metal ions and the molar ratio of the metal ion to phosphonate compounds are therefore critical features of the complex to achieve the object of the invention.

Preferred metal ions are calcium and zinc and aluminium ions because of their convenient way of obtaining their complexes in a solid form.

The metal complexes of the organic phosphonate compounds EDTMP and DTPMP can be prepared by mixing the organic phosphonate compound with the appropriate amount of a suitable metal compound which generates the metal ion in a solvent medium whilst adjusting the pH, if necessary, to form the complex. Suitable metal compounds are the water-soluble salts of calcium, magnesium, zinc or aluminum, and the hydroxides or oxides of said metals. The solvent may be water or a molten nonionic surfactant or any other inert solvent.

Generally a pH of at oeast 10, preferably about 12, will be required to form the calcium and magnesium complexes, whereas a lower pH will be sufficient to induce the formation of zinc or aluminium complexes.

The metal complex obtained from the above process can as such be incorporated in the detergent slurry before spray-drying or admixed with the dry detergent base powder.

A preferred way of presenting the metal complex is by forming it into granules with an organic or inorganic binding material. A suitable organic binding material is e.g. a nonionic surfactant. Suitable inorganic binding materials include sodium tetraborate (borax), sodium sulphate, and sodium triphosphate. Such granules can be conveniently dosed to the detergent bleach composition by dry-mixing.

Any granulation technique known in the art can be employed, e.g. by spraying a molten nonionic surfactant on to a moving bed of the dried metal complex. A convenient alternative is to co-granulate the metal complex with an activator for percompounds in which case the moving bed comprises a mixture of said complex and the activator.

The metal complex in whatever form, when incorporated in bleaching and cleaning compositions comprising a percompound bleach and an organic activator for percompounds, shows improved stability of the organic phosphonate compound, which is essential for optimising the bleaching capacity of the bleaching and cleaning compositions.

The bleaching and cleaning composition of the invention may be presented as a true bleach comprising essentially the percompound bleach, the activator and the phosphonate metal complex, though conveniently it is preferably presented as a fully formulated heavy duty built detergent bleach composition for washing and bleaching textiles in washing machines. The amount of phosphonate metal complex calculated as phosphonic acid in the bleaching and cleaning composition of the invention will generally be from about 0.01–5.0% by weight, preferably from about 0.05–2.0% by weight.

The percompounds which may be used in conjunction with the activator and the metal complex according to the invention include hydrogen peroxide and its derivatives, such as the alkalimetal peroxides and superoxides, perborates, persilicates, percarbonates, perpyrophosphates and urea peroxide. The inorganic percompounds, especially perborates and percarbonates, are preferred because of their commercial availability. Their level in a fully formulated detergent bleach composition will generally be within the range of 5 to 35% by weight of the composition.

The activators used are of the type well-known in the art. Preferred activators are those having at least one RCON<group in the molecule, wherein RCO represents an acyl radical. Suitable activators include:

(a) N-diacylated and N,N'-polyacylated amines, such as N,N,N',N'-tetraacetyl methylene diamine and N,N,N',N'-tetraacetyl ethylene diamine, N,N-diacetylaniline, N,N-diacetyl-p-toluidine; 1,3-diacylated hydantoins such as, for example, 1,3-diacetyl- 5,5-dimethyl hydantoin and 1,3-dipropionyl hydantoin; α-acyloxy-(N,N')-polyacylmalonamide, for example α-acetoxy- (N,N')-diacetylmalonamide;

(b) N-alkyl-N-sulphonyl carbonamides, for example the compounds N-methyl-N-mesyl-acetamide, N-methyl-N-mesyl-benzamide, N-methyl-N-mesyl-p-nitrobenzamide, and N-methyl-N-mesyl- p-methoxybenzamide;

(c) N-acylated cyclic hydrazides, acylated triazoles or urazoles, for example monoacetylmaleic acid hydrazide;

(d) O,N,N-trisubstituted hydroxylamines, such as O-benzoyl-N,N-succinyl hydroxylamine, O-acetyl-N,N-succinyl hydroxylamine, O-p-methoxybenzoyl-N,N-succinyl-hydroxylamine, O-p-nitro- benzoyl-N,N-succinyl-hydroxylamine and O,N,N-triacetyl hydroxylamine;

(e) N,N'-diacyl-sulphurylamides, for example N,N'-dimethyl-N,N'-diacetyl-sulphurylamide and N,N'-diethyl-N,N'-dipropionyl sulphurylamide;

(f) Triacylcyanurates, for example triacetyl cyanurate and tribenzoyl cyanurate;

(g) Carboxylic acid anhydrides, such as benzoic anhydride, m-chloro-benzoic anhydride, phthalic anhydride, 4-chlorophthalic anhydride;

(h) Sugar esters, for example glycose pentaacetate;

(i) 1,3-diacyl-4,5-diacyloxy-imidazolidine, for example 1,3-diformyl-4,5-diacetoxy-imidazolidine, 1,3-diacetyl-4,5-diacetoxy-imidazolidine, 1,3-diacetyl-4,5-dipropionyloxy- imidazoline;

(j) Tetraacetylglycoluril and tetrapropionylglycoluril;

(k) Diacylated 2,5-diketopiperazine, such as 1,4-diacetyl-2,5- diketopiperazine, 1,4-dipropionyl-2,5-diketopiperazine and 1,4-dipropionyl-3,6-dimethyl-2,5-diketopiperazine;

(l) Acylation products of propylenediurea or 2,2-dimethyl- propylenediurea (2,4,6,8-tetraaza-bicyclo-(3,3,1)-nonane- 3,7-dione or its 9,9-dimethyl derivative), especially the tetraacetyl- or the tetrapropionyl-propylenediurea or their dimethyl derivatives;

(m) Carbonic acid esters, for example the sodium salts of p-(ethoxycarbonyloxy)-benzoic acid and p-(propoxy-carbonyloxy)-benzenesulphonic acid.

The N-diacylated and N,N'-polyacylated amines mentioned under (a) are of special interest, particularly N,N,N',N'-tetraacetyl-ethylenediamine (TAED).

These activators may be used in the compositions of the invention in any ratio by weight to the percompound varying from about 1:1 to about 1:35, preferably from 1:2 to 1:20. In practice the level of organic activator in the bleaching and cleaning composition of the invention will be in the range of from about 0.15 to 30% by weight, preferably from about 0.25 to 15% by weight.

Apart from the above three ingredients the bleaching and cleaning composition of the invention may further comprise a detergent-active material in proportions of about 5–40% and in general also detergency builders in proportions of about 10–60%. Further, alkaline components, fillers and the usual adjuncts, such as optical brighteners, soil suspending agents, sequestering agents, perfumes, colouring agents, etc. may be present. Also enzymes, particularly proteolytic and amylolytic enzymes, may be present in the composition of the invention.

The detergent active material present in the composition may be a single active or a mixture of actives. The actives may be selected from the group of anionic, nonionic, amphoteric and zwitterionic detergent compounds and mixtures thereof. Examples of anionic detergent compounds are alkylaryl sulphonates (e.g. sodium dodecylbenzenesulphonate); products of the sulphonation of olefins, so-called olefinsulphonates; fatty alcohol sulphates; alkylether sulphates, in the form of their alkali metal salts, and alkali metal salts of long-chain $C_8$-$C_{22}$ fatty acids.

Nonionic detergent compounds can be broadly defined as compounds produced by the condensation of alkylene oxide groups with an organic hydrophobic compound which may be aliphatic or alkyl- aromatic in nature. The length of the polyalkylene oxide group which is condensed with any particular hydrophobic group can be readily adjusted to yield a water-soluble compound having the desired degree of balance between hydrophilic and hydrophobic elements. Examples of suitable nonionic detergent compounds are the condensation products of $C_{6'}$-$_{C12}$ alkylphenols with 5-25 moles of ethylene oxide per mole of alkylphenol; the water- soluble condensation products of $C_{8'}$-$_{C22}$ aliphatic alcohols, either straight or branched chained, with 5-30 moles of ethylene oxide per mole of alcohol.

Amphoteric detergents include derivatives of aliphatic or aliphatic derivatives of heterocyclic secondary or tertiary amines in which the aliphatic moiety can be straight-chain or branched and wherein one of the aliphatic substituents contains from 8 to 18 carbon atoms and at least one aliphatic substituent contains an anionic water-solubilizing group.

Zwitterionic detergents include derivatives of aliphatic quaternary ammonium, phosphonium and sulphonium compounds in which the aliphatic moieties can be straight-chain or branched, and wherein one of the aliphatic substituents contains from 8 to 18 carbon atoms and one contains an anionic water-solubilizing group.

Other detergent-active materials are described in the books "Surface-Active Agents," Vol. I, by Schwartz and Perry (Interscience 1949) and "Surface Active Agents and Detergents," Vol. II, by Schwartz, Perry and Berch (Interscience 1958), the disclosures of which are included herein by way of reference.

Examples of detergency builders are sodium and potassium triphosphate; sodium orthophosphate; sodium and potassium pyrophosphate; sodium carbonate; organic non-phosphate builders such as nitrilotriacetic acid and its water-soluble salts, sodium ethylenediaminetetraacetate, carboxymethyloxymalonate, carboxymethyloxysuccinate; and the various alumino silicates such as zeolite.

EXAMPLES I-V

The following Examples illustrate the preparation of some metal complexes usable in the bleaching and cleaning composition of the invention:

I. Preparation of tri-magnesium complex of ethylene diamine tetra-(methylene phosphonate) at pH 12 ($Mg_3$-EDTMP)

5 kg of ethylane diamine tetra-(methylene phosphonic acid) were dispersed in 5 kg water by stirring in a stainless steel crutcher. 9.37 kg of 50% sodium hydroxide solution were added to bring the pH to approximately 12. This reaction was exothermic and cooling was therefore applied to control the temperature. To this reaction mixture 10.35 kg of 40% magnesium sulphate solution were added slowly with constant stirring. A check on the pH of the final mixture indicated the need for the addition of a further 2 kg of 50% NaOH solution to maintain the pH at 12. The resulting product was a liquid, which can be adsorbed on dry salts, e.g. sodium tetraborate, sodium triphosphate or sodium sulphate, to obtain a particulate product.

II. Preparation of tri-calcium complex of ethylene diamine tetra-(methylene phosphonate) at pH 12 ( $Ca_3$-EDTMP)

5 kg of ethylene diamine tetra-(methylene phosphonic acid) were dispersed in 5 kg water by stirring in a stainless steel crutcher. 9.37 kg of 50% NaOH solution were added to bring the pH to approximately 12. This reaction was exothermic and cooling was therefore applied to control the temperature. To this reaction mixture 5.80 kg of 66% calcium chloride solution was added slowly with constant stirring. A white precipitation of the complex was obtained and a check on the pH indicated the need for the addition of a further 1.1 kg of 50% NaOH solution to bring the pH back to 12.0.

The resulting product was a slurry.

To obtain a dry product from this slurry, the following process routes can be followed:

(a) Thermal drying process
  (i) Drum-drying;
  (ii) Spray-drying;
  The slurry is mixed with e.g. sodium tetraborate and/or sodium triphosphate and optionally water to adjust the slurry viscosity and thereafter spray-drying said slurry in a spray-drying tower to obtain a particulate dry product.
  (iii) Vacuum-drying.
(b) Addition of drying agent(s) for example anhydrous salts, such as sodium tetraborate, sodium sulphate and sodium triphosphate, whereby a dry millable mass is obtained.

The dry products thus obtained can be further granulated and/or coated, if necessary, in the usual manner, e.g. by spraying a molten nonionic surfactant in a granulation pan.

III. Preparation of tricalcium complex of ethylene diamine tetra-(methylene phosphonic acid) at pH 12 ($Ca_3$-EDTMP)

The process used was as in Example II but a potassium triphosphate solution was used instead of water to disperse to ethylene diamine tetra-(methylene phosphonic acid). The resulting product was a low viscosity liquid, which can be sprayed on to a moving bed of sodium triphosphate or a mixture of sodium triphosphate and tetraacetyl-ethylene diamine (activator) to obtain a dry granulated product.

IV. Preparation of $A1_1$-EDTMP and $A1_2$-EDTMP (a) 4.4 g of NaOH-pellets were dissolved in 50 g of water.

To this solution 23.5 g of ethylene diamine tetra-(methylene phosphonic acid) were added and thereafter 32.5 g of aluminium sulphate $16.H_2O$ (0.05 mole). The aluminium sulphate was added as a solution in approximately 1.5 times its own weight of water. A milky white precipitate was formed, which was filtered off, using a Buchner funnel with 542 filter-paper. The filter cake was dried in an over at 110°-120° C., ground in a mortar and pestle, and sieve through a 355μ sieve.

(b) 4.4 g of NaOH-pellets were dissolved in 50 g of water. To this solution 23.5 g of ethylene diamine tetra-(methylene phosphonic acid) were added and thereafter 65.0 g of aluminium sulphate $16.H_2O$ (0.1 mole). The aluminium sulphate was added as a solution in approximately 1.5 times its own weight of water. A milky white precipitate was formed, which was filtered off, using a Buchner funnel with 542 filter-paper. The filter cake was dried, ground and sieved as in Example Va.

V. Preparation of $Zn_1$-EDTMP.

To 3.35 kg of water in a stirred crutcher were added 3.0 kg of ethylene diamine tetra (methylene phosphonic acid), followed by 1.7 kg of caustic soda flakes. When all the ethylene diamine tetra (methylene phosphonic acid) was dissolved, 3.95 kg of a zinc sulphate solution (made from 1.975 kg $ZnSO_4.7H_2O$ in 1.975 kg water) were added slowly. The slurry obtained was drum-dried to obtain a particulate dry product.

EXAMPLE VI

A spray-dried $Ca_3$-EDTMP/sodium tetraborate powder of the following composition was prepared:

| | |
|---|---|
| $Ca_3$-EDTMP | 22% by weight (≈ 17.3% as EDTMP-acid) |
| sodium tetraborate | 73% by weight |
| water | 5% by weight |

The powder had a bulk density of about 0.1 kg/liter.

71 parts of this powder were sprayed with 29 parts of tallow fatty alcohol condensed with 25 ethylene oxide (nonionic surfactant) in a granulation pan to obtain a dry granulated product comprising about 12% EDTMP calculated as EDTMP-acid (H-EDTMP).

EXAMPLE VII

To a conventional detergent base powder was added 13% sodium perborate tetrahydrate and 4% tetraacetyl ethylene diamine (activator) and also:

(i) EDTMP-acid (H-EDTMP)
(ii) $Ca_1$-(EDTMP) prepared at pH 12
(iii) $Ca_2$-(EDTMP) prepared at pH 12
(iv) $Ca_3$-(EDTMP) prepared at pH 12.

Pre-weighed samples were stored in covered Petri dishes in the 37° C./ 70% RH stove, and whole samples were analysed for residual EDTMP at intervals with the following results:

| | Residual EDTMP (%) in sample | | | |
|---|---|---|---|---|
| Storage time (days) | (i) H | (ii) $Ca_1$ | (iii) $Ca_2$ | (iv) $Ca_3$ |
| 2 | 52 | 67 | 67 | 70 |
| 5 | 51 | 63 | 62 | 71 |

-continued

| | Residual EDTMP (%) in sample | | | |
|---|---|---|---|---|
| Storage time (days) | (i) H | (ii) $Ca_1$ | (iii) $Ca_2$ | (iv) $Ca_3$ |
| 10 | 26 | — | — | 40 |

The above results show the superiority of the calcium complex over the acid compound.

EXAMPLE VIII

Calcium complex systems of EDTMP at molar ratios of 1:1, 2:1 and 3:1 calcium to EDTMP were prepared by dissolving EDTMP-acid in a caustic soda solution to give the sodium salt solutions, and reacting these with calcium chloride solutions at the above mole ratios. The solids obtained were isolated by drum drying. X-ray fluorescence data showed stoichiometres of 1:1, 1.95:1 and 3.08:1, respectively.

They were mixed at 1% level, calculated as EDTMP-acid, with a mixed active detergent powder comprising the usual ingredients and 13.5% by weight of total active, 36% by weight of sodium triphosphate, 13% by weight of sodium perborate and 4% by weight of tetraacetyl ethylene diamine (activator). The mixtures were stored at 37° C./70% RH for 3 and 5 days in open packs (400 g product per pack).

The residual activities of EDTMP are shown below and compared with non-complexed EDTMP-acid added in the same way as control.

| | Residual EDTMP (%) in samples | | | |
|---|---|---|---|---|
| Storage time (days) | H | $Ca_1$ | $Ca_2$ | $Ca_3$ |
| 3 | 54 | 81 | 86 | 83 |
| 5 | 32 | 62 | 73 | 77 |

These results show an advantage of the calcium complex system, the effect increasing with the Ca/EDTMP ratio.

EXAMPLE IX

To a conventional mixed active detergent base powder were added 15% sodium perborate tetrahydrate and 2% tetraacetylethylene diamine (activator) and also:

(i) H-EDTMP/tallow alcohol-25 EO noodles
(ii) H-EDTMP/tallow alcohol- 25 EO granules
(iii) $Ca_3$-EDTMP/tallow alcohol-25 EO noodles
(iv) $Ca_3$-EDTMP/tallow alcohol -25 EO granules
(v) $Ca_3$-EDTMP/borax-spray-dried powder.

All the finished powders contained nominally 0.3% EDTMP calculated as H-EDTMP.

The powders were stored in polyethylene laminated cartons under three conditions, i.e. ambient, 20° C./90% RH and 37° C./70% RH and sampled for % EDTMP remaining. The results are shown in the following table.

| | % EDTMP remaining after 4 weeks | | | | |
|---|---|---|---|---|---|
| Storage conditions | (i) | (ii) | (iii) | (iv) | (v) |
| ambient | 80 | 70 | 100 | 100 | 90 |
| 20° C./90% RH | 87 | 60 | 100 | 100 | 60 |
| 37° C./70% RH | 37 | 0 | 100 | 100 | 60 |
| 37° C./70% RH (10 weeks) | 0 | 27 | 90 | 70 | 40 |

EXAMPLE X

The following bleaching and cleaning composition was prepared:

| | |
|---|---|
| sodium alkylbenzene sulphonate | 7.0% |
| fatty alcohol ethoxylate | 2.5% |
| sodium soap | 2.5% |
| sodium triphosphate | 36.0% |
| sodium silicate | 6.0% |
| ethylene diamine tetraacetate (EDTA) | 0.1% |
| sodium sulphate | 23.0% |
| fluorescer | 0.2% |
| sodium carboxymethyl cellulose | 0.5% |
| $Mg_3$-EDTMP complex | 0.3% |
| sodium perborate | 15.0% |
| tetraacetylethylene diamine (TAED) | 2.0% |
| water | up to 100.0% |

All ingredients including $Mg_3$-EDTMP, except sodium perborate and TAED, were formed into a slurry and spray-dried to a base powder, whereupon sodium perborate and TAED were dry-dosed. The $Mg_3$-EDTMP was prepared as described in Example I.

The finished powder was stored in polyethylene laminated cartons and analysed for residual EDTMP.

The results were as follows:

| Storage condition | Time (weeks) | Residual EDTMP (%) |
|---|---|---|
| ambient | 12 | 53 |
| 20° C./90% RH | 4 | 43 |
| 37° C./70% RH | 4 | 30 |
| 37° C./70% RH | 10 | 20 |

These results show that $Mg_3$-EDTMP complex incorporated in the slurry during the preparations of the bleaching and cleaning composition remains relatively stable on storage.

EXAMPLE XI $Al_2$-EDTMP of Example V, together with sodium perborate and tetra acetyl ethylene diamine, were dry dosed into a conventional spray-dried mixed active detergent base powder to form a bleaching and cleaning composition comprising 10% sodium perborate, 4% tetra-acetyl ethylene diamine (TAED) and 1% $AL_2$-EDTMP complex.

The following storage results were obtained.

| % remaining after storage | | | | | | | | |
|---|---|---|---|---|---|---|---|---|
| 4 weeks 37° C./70% RH | | | 12 weeks 37° C./70% RH | | | 18 weeks ambient | | |
| EDTMP | TAED | Perborate | EDTMP | TAED | Perborate | EDTMP | TAED | Perborate |
| 78 | 92 | 91 | 67 | 81 | 78 | 78 | 73 | 91 |

The excellent stability of the bleaching and cleaning composition was evident.

EXAMPLE XII

The following example illustrates a bleaching and cleaning composition within the invention.

| Composition: | % by weight |
|---|---|
| sodium dodecylbenzene sulphonate | 7.0 |
| tallow alcohol ethoxylate | 2.5 |
| sodium stearate | 2.5 |
| sodium triphosphate | 36.0 |
| sodium silicate | 6.0 |

-continued

| Composition: | % by weight |
|---|---|
| ethylene diamine tetraacetate (EDTA) | 0.1 |
| fluorescer | 0.2 |
| sodium sulphate | 23.0 |
| EDTMP-acid | 0.1 |
| sodium perborate tetrahydrate | 6.0 |
| tetra acetylethylene diamine (TAED) | 3.0 |
| $Ca_2$-EDTMP complex | 0.2 |
| water up to 100% | |

This composition was prepared by preparing an aqueous slurry of the ingredients above the dotted line, which was spray-dried to form a base powder to which the sodium perborate, TAED and the $Ca_2$-EDTMP complex were post-dosed by dry mixing.

EXAMPLE XIII

The following detergent bleach powder compositions were prepared by the conventional spray-drying technique; the ingredients above the dotted line were spray-dried from an aqueous slurry, sodium perborate and N,N,N',N'-tetraacetylethylene diamine were mixed to the spray-dried base powder by dry-mixing.

| Composition (in % by weight) | I | II |
|---|---|---|
| Sodium dodecylbenzene sulphonate | 7.0 | 7.0 |
| Fatty alcohol/11-25 EO condensate | 2.5 | 2.5 |
| sodium triphosphate | 37.0 | 37.0 |
| sodium silicate | 6.0 | 6.0 |
| sodium carboxymethylcellulose | 0.7 | 0.7 |
| ethylene diamine tetraacetate | 0.1 | 0.1 |
| fluorescer | 0.15 | 0.15 |
| sodium sulphate | 23.0 | 23.0 |
| Na-EDTMP | 0.19 | — |
| $Zn_1$-EDTMP | — | 0.15 |
| sodium perborate tetrahydrate | 6.0 | 6.0 |
| N,N,N',N'-tetraacetylethylenediamine | 3.0 | 3.0 |
| water up to 100% | | |

The powders were stored in closed plastic containers and stored for 3 weeks at 37° C. and 70% relative humidity. On analysis composition I showed 0% EDTMP and composition II showed 0.05% EDTMP left over after 3 weeks' storage. The improved stability of $Zn_1$-EDTMP complex over non-complexed EDTMP is evident.

EXAMPLE XIV

To a conventional spray-dried detergent base powder were added 6% of sodium perborate tetrahydrate and 3% of tetraacetyl ethylene diamine and also (1) 0.35% of $Zn_1$-EDTMP complex; and (2) 0.33% of EDTMP-acid (H-EDTMP)

by dry-mixing

The two powders were stored at 37° C./70% RH in closed plastic containers for 6 days and analysed for EDTMP remaining.

The results were:

| | % | % residual activity |
|---|---|---|
| Composition 1 ($Zn_1$-EDTMP) | 0.23 | 66 |
| Composition 2 (H-EDTMP) | 0.18 | 55 |

Again the Zn-complex of EDTMP was found more stable than the non-complexed EDTMP.

We claim:

1. A bleaching and cleaning composition comprising a percompound bleach, an activator for said percompound bleach and an organic phosphonate compound, selected from the group consisting of ethylene diamine tetra-methylene phosphonate -"EDTMP", and diethylene triamine penta-(methylene phosphonate) - "DTPMP", and mixtures thereof, wherein said organic phosphonate compound is present as a complex of a metal ion selected from the group consisting of calcium, magnesium, zinc and aluminium ions, the molar ratio of said metal ion to said phosphonate compound being at least 1:1.

2. A bleaching and cleaning composition according to claim 1, wherein said molar ratio of said metal ion to said phosphonate compound is at least 2:1.

3. A bleaching and cleaning composition according to claim 1, wherein said metal complex is present in an amount of from 0.01 to 5.0% by weight, calculated as phosphonic acid.

4. A bleaching and cleaning composition according to claim 3, wherein said amount of metal complex is from 0.05 to 2.0% by weight.

5. A bleaching and cleaning composition according to claim 1, which comprises 5 to 35% by weight of percompound bleach.

6. A bleaching and cleaning composition according to claim 1, wherein said activator is present in a ratio by weight to the percompound of 1:1 to 1:35.

7. A bleaching and cleaning composition according to claim 6, wherein said ratio is from 1:2 to 1:20.

8. A bleaching and cleaning composition according to claim 6, which comprises 0.15 to 30% by weight of said activator.

9. A bleaching and cleaning composition according to claim 8, which comprises 0.25 to 15% by weight of said activator.

10. A bleaching and cleaning composition according to claim 1, which further comprises 5 to 40% by weight of a detergent active material and 10 to 60% by weight of a detergency builder.

11. A bleaching and cleaning composition according to claim 1, wherein said complex is a calcium, zinc or aluminium complex of EDTMP.

12. A bleaching and cleaning composition according to claim 1, wherein said percompound bleach is sodium perborate.

13. A bleaching and cleaning composition according to claim 1, wherein said activator is N,N,N'N'-tetraacetylethylene diamine.

* * * * *